US005613490A

United States Patent [19]

Mayes et al.

[11] Patent Number: 5,613,490

[45] Date of Patent: Mar. 25, 1997

[54] COMPACT, LIGHTWEIGHT BREATHABLE AIR PRESSURE VESSEL

[76] Inventors: Richard P. Mayes, 3210 Jefferson Ave., Ogden, Utah 84403; Richard Y. Royer, 572 E. 1950 North, Ogden, Utah 84414; Ward D. Hubbard, 2675 Lawrence Ave., San Bernadino, Calif. 92404

[21] Appl. No.: 282,523

[22] Filed: Jul. 28, 1994

[51] Int. Cl.[6] ..... A62B 7/00; A62B 9/00; A62B 18/10; B63C 11/02

[52] U.S. Cl. ..... 128/205.22; 128/201.27; 128/201.28; 220/581; 220/582

[58] Field of Search ..... 128/205.22, 201.21, 128/201.26–201.28, 202.27, 204.18, 204.26, 205.24; 222/581, 582

[56] References Cited

U.S. PATENT DOCUMENTS 1,082,213 12/1913 Robinson .
3,000,191 9/1961 Stark .
4,362,153 12/1982 Wilson et al. .
4,365,628 12/1982 Hodel .
4,409,978 10/1983 Bartos .
5,027,810 7/1991 Patureau et al. .
5,042,474 8/1991 Williamson .
5,318,019 7/1994 Celaya .

OTHER PUBLICATIONS

Description of a Use of Product Known to Applicants, Oct. 28, 1994, Richard P. Mayes, Richard Y.Royer, and Ward D. Hubbard.

*Primary Examiner*—Kimberly L. Asher
*Attorney, Agent, or Firm*—Thorpe, North & Western, L.L.P.

[57] ABSTRACT

A portable pressure tank for storing breathable air. An elongate tank body is made from a metal alloy capable of much higher air cycles even when subjected to pressure densities in the range of 40,650 lb/in$^3$ on a regular basis. The tank body can be less than ten inches long and weighs less than five pounds when filled to about 64 ft$^3$ of air at 5,000 psi.

20 Claims, 6 Drawing Sheets

COMPACT, LIGHTWEIGHT BREATHABLE AIR PRESSURE VESSEL

BACKGROUND OF THE INVENTION

1. The Field of the Invention

The present invention relates generally to the field of breathable air storage vessels. More particularly, it concerns a miniaturized lightweight air pressure vessel for use as a portable source of breathable air.

2. The Background Art

Portable breathable air tanks are known in the art for use in activities such as scuba diving and fire fighting. Tanks have been built which are strong enough to withstand pressures in the range of 2,000 psi to 3,000 and which are light enough to be carried strapped to the user's back. The conventional breathable air tanks known to applicants are made of cast steel or aluminum.

However, the conventional breathable air tanks are characterized by a number of disadvantages. The strength of the metal used in the tanks requires a tank to be larger and heavier in order to withstand the pressures in the 3,000 psi range. The larger and heavier the tank, the more breathable air it can hold and the higher failure strength it has but the more difficult it is for the user to maneuver. The competing needs of size, strength and maneuverability require a judgment call in optimizing the design. The conventional tank which weighs about thirty-five pounds and holds about thirty-five to forty minutes worth of breathable air, and tends to have a safe use limit of about 3,000 cycles of air. The conventional tanks are so heavy that only two tanks can be safely worn by one person at a time. Although smaller vessels made of stronger metal have been developed for storing industrial gases and the like, no such tanks have been developed for storing breathable air. Of current interest are portable tanks for containing breathable air which are smaller, lighter and capable of holding more air at higher pressures.

OBJECTS AND SUMMARY OF THE INVENTION

It is therefore an object of the present invention to provide a portable air storage tank for supplying breathable air to a user.

It is another object of the invention to provide such an air storage tank which is smaller, lighter and capable of holding more air at higher pressures.

It is a further object of the invention to provide such an air storage tank having a higher safe use limit of cycles of air.

The above objects and others not specifically recited are realized in a specific illustrative embodiment of a portable pressure tank for storing breathable air. An elongate tank body is made from a metal alloy capable of much higher air cycles even when subjected to pressure densities in the range of 40,650 lb/in$^3$ on a regular basis. The tank body can be less than ten inches long and weighs less than approximately five pounds when filled to about 64 ft$^3$ of air at 5,000 psi.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 2:
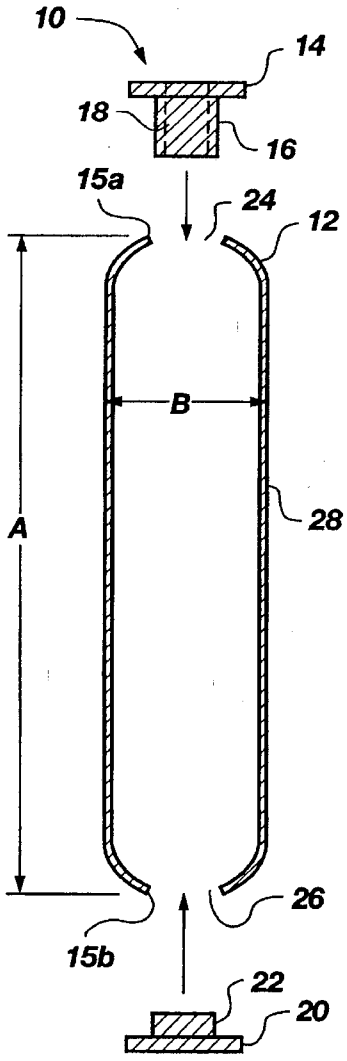
FIG. 2 illustrates an exploded, side cross sectional view of a portable air storage tank made in accordance with the principles of the present invention.
Figure 1A:
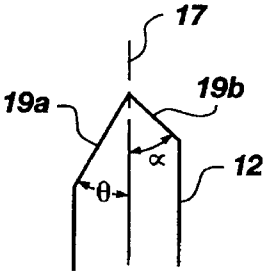
FIG. 1A illustrates a magnified view of a chamfered edge portion of the cylinder of FIG. 1.
Figure 1:
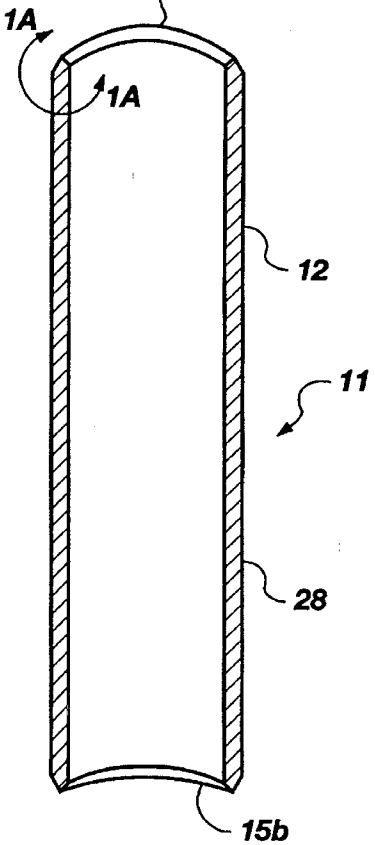
FIG. 1 illustrates a side, cross sectional view of an elongate cylinder having chamfered edges.
Figure 3:
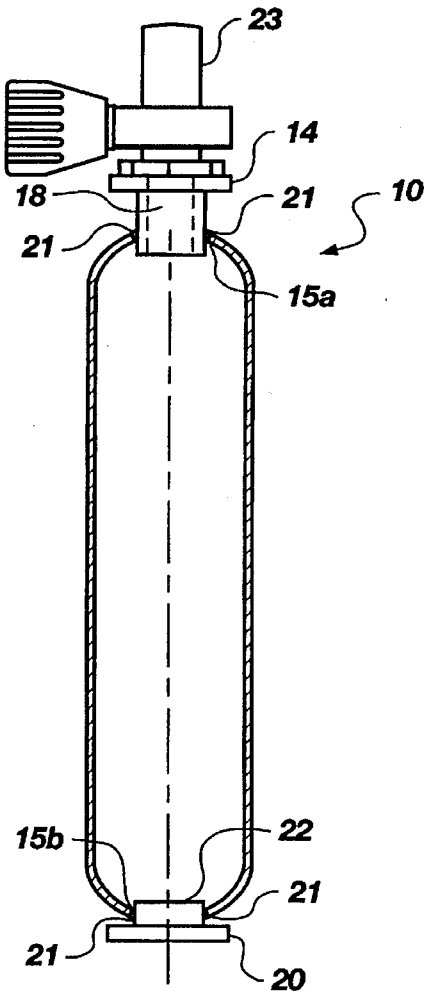
FIG. 3 illustrates a side, cross sectional view of the air storage tank of FIG. 2 in an assembled configuration.

Referring now to FIGS. 1–3, there is shown a portable air storage tank generally designated at 10. The tank 10 is preferably formed from an extruded steel alloy of 9310 seamless steel tubing as known in the field. Applicants' chemical analysis of this alloy revealed the composition to include Carbon (0.09%), Manganese (1.25%), Phosphorus (0.013%), Sulfur (0.003%), Silicon (0.27%) and Iron (remainder, or approximately 98.37%). The preferred alloy thus includes Carbon, Manganese, Silicon and Iron, as the Phosphorus and Sulfur components are probably contaminants. It is within the scope of the present invention make the tank 10 from various amounts Carbon, Manganese, Silicon and Iron, including the ranges of approximately 0.04% to 0.20% Carbon, approximately 0.5% to 2.0% Manganese, approximately 0.10% to 0.50% Silicon and approximately 97.30% to 99.36% Iron.

The tank 10 includes a tank body 12, an upper cap 14 and a lower plug cap 20. The upper cap 14 includes an insertable portion 16 and an air transmission passage 18. The lower plug cap 20 includes an insertable projection 22. The upper and lower caps 14 and 20 are inserted into respective upper and lower openings 24 and 26 of the tank body 12 as shown, and are sealably disposed therein such that the tank only communicates via the air transmission passage 18. Referring now to FIG. 3, welds 21 as known in the art secure the upper and lower caps 14 and 20 to the tank body 12. A valve 23 is disposed upon the upper cap 14 for selectively opening and closing the air transmission passage 18.

The tank body 12 includes walls 28, which are preferably within a range of approximately 0.115 inches to 0.25 inches thick. The walls 28 are most preferably either 0.123 inches thick or 0.110 inches thick, will tolerances of ±0.002 inches. The tank body 12 has a length A which is preferably within a range of approximately nine inches to ten inches, and an outer diameter B which is preferably within a range of approximately 2.375 inches to 2.380 inches.

Figure 6:
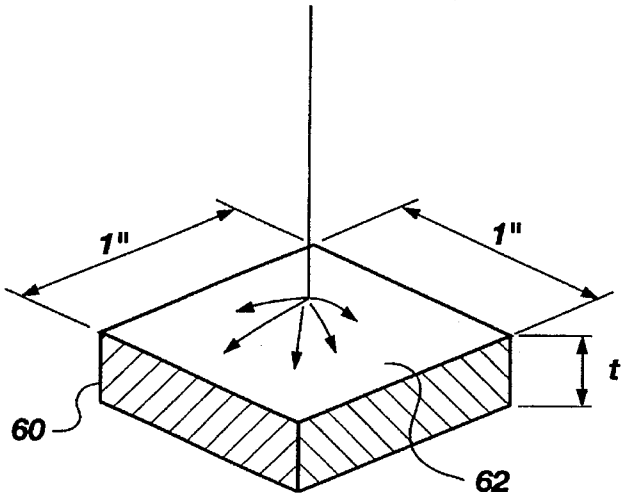
FIG. 6 illustrates a pressure density exerted by a force upon an object.

Applicants have found that when the tank 10 is extruded from the alloy described above, it is capable of holding air at much higher pressures than the prior art breathable air tanks. This can be described in terms of pressure density which, as used herein, shall refer to a three-dimensional pressure component. Pressure density is the pressure exerted through the volume of an object. Referring to FIG. 6, a force F is shown to be applied to an object 60 so as to be distributed across a surface 62 of the object. If the surface area of the surface 62 is 1 $in^2$ as shown, then the pressure exerted upon the surface 62 of the object 60 is equal to F $lb/in^2$. It is readily understood by those skilled in the relevant mathematics that the pressure is independent of a thickness t of the object 60. However, the pressure density captures the dimension of the thickness t of the object 60, since the thicker the object is the higher value of force F it can withstand.

More specifically, the pressure density exerted upon the object 60 is equal to the force F divided by the volume of the object 60, which is readily seen to be t $in^3$. Thus, if the force F is equal to 5,000 pounds and the thickness t is equal to 0.123 inches, the pressure density would be (5,000 lb)/(1 in)(1 in)(0.123 in)=40,650 $lb/in^3$. Applicants' tank 10 with the walls 12 having a preferred thickness of 0.123 inches can safely withstand air pressures of 5,000 psi, and thus a pressure density of 40,650 $lb/in^3$. When the tank body 12 is built to have a length A of 9.663 inches and an outer diameter B within a range of 2.375 inches and 2.380 inches, applicants estimate that it can safely store approximately 64 $ft^3$ of breathable air.

Referring to FIGS. 1–3, the tank 10 is preferable formed by selecting a straight elongate pipe 11 (FIG. 1), cutting it to a desired length, and chamfering the opposing edges as shown at 15*a* and 15*b*, respectively. FIG. 1A illustrates a preferred chamfer in accordance with the present invention. An outer chamfered edge 19*a* of the pipe 11 forms an angle θ equal to approximately thirty degrees relative to a centerline 17 of the wall 12. An inner chamfered edge 19*b* of the pipe 11 forms an angle α equal to approximately forty-five degrees relative to the centerline 17. The edges 15*a–b* are then formed by a hydraulic press or other suitable means into a partially hemispherical shape as shown in FIG. 2. Applicants have found that the chamfering provides a number of advantages, such as minimizing bunching of the edges 15*a–b* during forming and providing a more suitable seating surface for the upper and lower caps 14 and 20.

A comparison of the present invention with the conventional breathable air tanks known to applicants shows that a tank built in accordance with the invention can withstand much higher pressure densities. For example, the conventional steel breathable air tank is approximately 3/16 inches thick and can safely hold air at about 2,500 $lb/in^2$. This translates to a pressure density of (2,500 $lb/in^2$)÷3/16 inches= 13,333 $lb/in^3$, much less than the 40,650 $lb/in^3$ permitted by applicants' tank 10.

Figure 4:
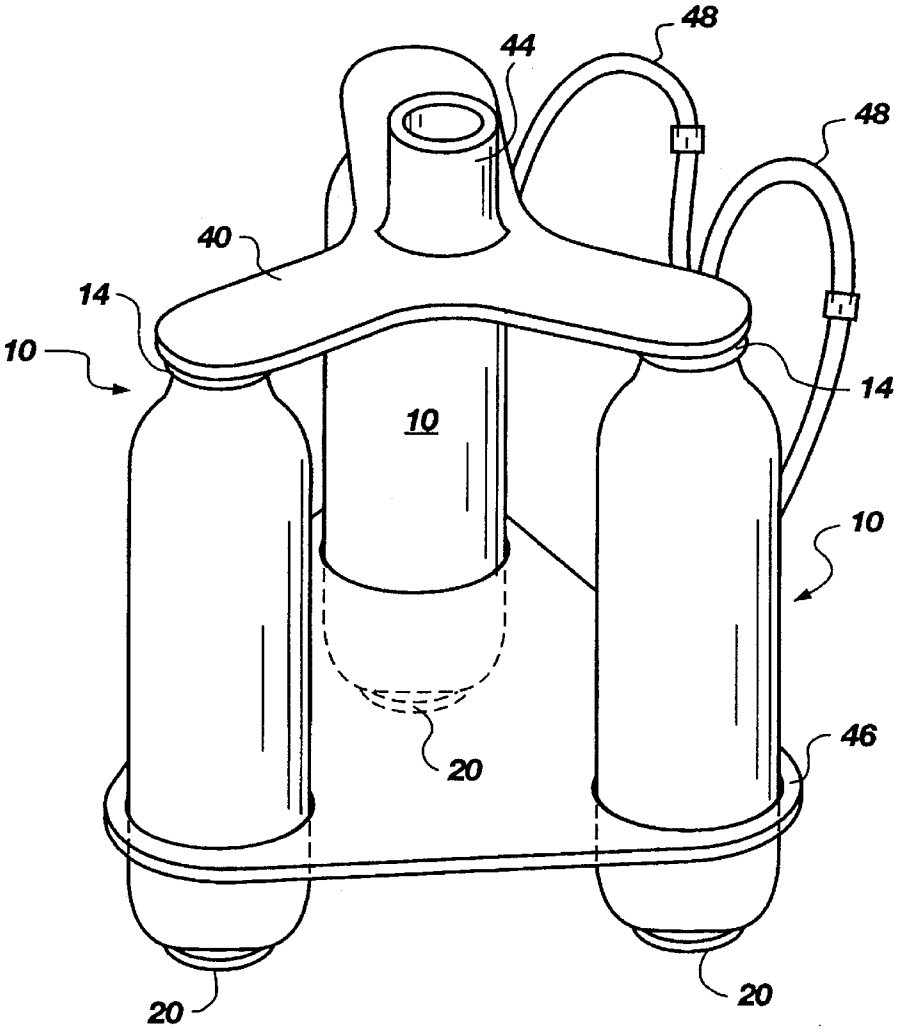
FIG. 4 illustrates a perspective view of a portable air storage system utilizing three storage tanks positioned in an equilateral triaxial orientation.

Although the prior art breathable air tanks can often hold air in the range of 65 $ft^3$ to 75 $ft^3$, they are typically about three feet long and nine inches in diameter, which is quite large and weighs about thirty-five pounds. Applicant's tank 10 having the tank body 12 of length A of 9.663 inches weighs about 4½ pounds when filled with 64 $ft^3$ of breathable air. This allows the user to wear comfortably two of the tanks 10 as in FIG. 7 which collectively weight about 15½ pounds including the valve 23. The user may even wear comfortably three of applicants' tanks 10 such as shown in FIG. 4 which collectively weigh about 21.25 pounds including a valve. The invention thereby provides more total air at one-half or even one-third the weight of the prior art tanks which are typically worn alone or in tandem sets of two at the most.

Figure 7:
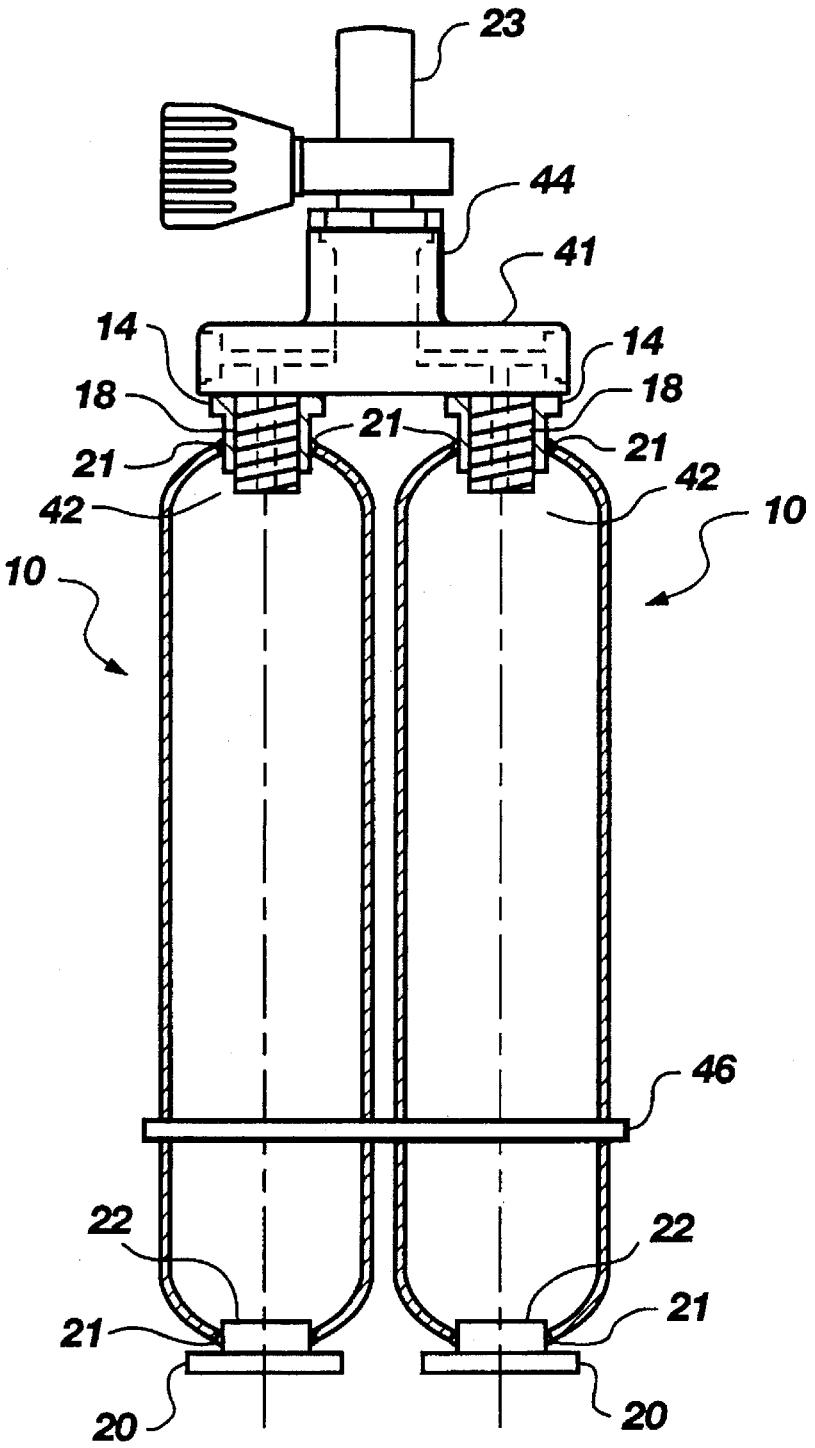
FIG. 7 illustrates a side, cross sectional view of an alternative embodiment of the air storage tank of FIG. 3, utilizing two storage tanks.

The configuration shown in FIG. 7 includes an air regulator 41 disposed in simultaneous communication with two of the air tanks 10. The air regulator 41 preferably includes two air inlet channels 42. As shown in phantom line, the air inlet channels 42 are disposed in communication with a common air outlet channel 44. The air inlet channels 42 are respectively sealably connected to the air transmission passages 18 of the upper cap 14 to thereby place each air tank 10 into communication with the common air outlet 44. A suitable dispensing means such as a valve 23 can be connected to the common air outlet 44 to dispense the air to the user such that the air is released substantially simultaneously and uniformly from each of the two tanks. A bracket 46 having two receiving holes may be used to stabilize the tanks 10 as in FIG. 7.

Figure 5A:
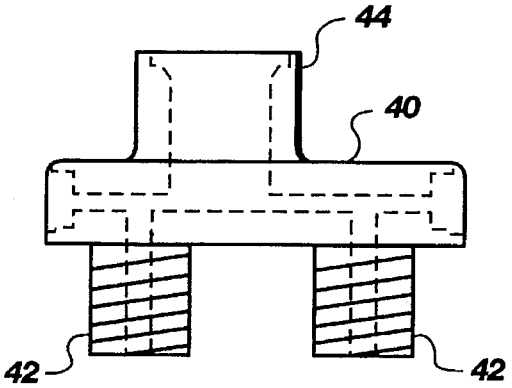
FIG. 5A illustrates a side view of a triaxial air regulator made in accordance with the principles of the present invention.
Figure 5B:
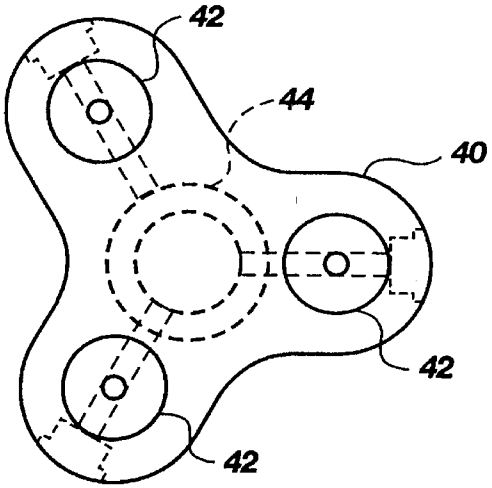
FIG. 5B illustrates a bottom view of the air regulator of FIG. 5A.

The configuration shown in FIG. 4 includes an air regulator 40 disposed in simultaneous communication with three of the air tanks 10. The air regulator 40 is shown in more detail in FIGS. 5A and 5B, and preferably includes three air inlet channels 42. As shown in phantom line, the air inlet channels 42 are disposed in communication with a common air outlet channel 44 and are positioned in a triaxial configuration. The air inlet channels 42 are preferably positioned in a substantially equilateral triaxial configuration. The air inlet channels 42 are respectively sealably connected to the air transmission passages 18 of the upper cap 14 to thereby position the air tanks 10 in a substantially equilateral triaxial configuration and to place each air tank into communication with the common air outlet 44. A suitable valve or other dispensing means as known in the art can be connected to the common air outlet 44 to dispense the air to the user such that the air is released substantially simultaneously and uniformly from each of the three tanks. A bracket 46 having three receiving holes may be used to stabilize the tanks 10 as in FIG. 4.

It is to be understood that the tank 10 may assume various dimensions. There are presently two preferred sets of dimensions. A smaller sized tank 10 preferably has a length A of approximately 9.663 inches, and a larger sized tank preferably has a length A of approximately 20.0 inches.

Figure 8:
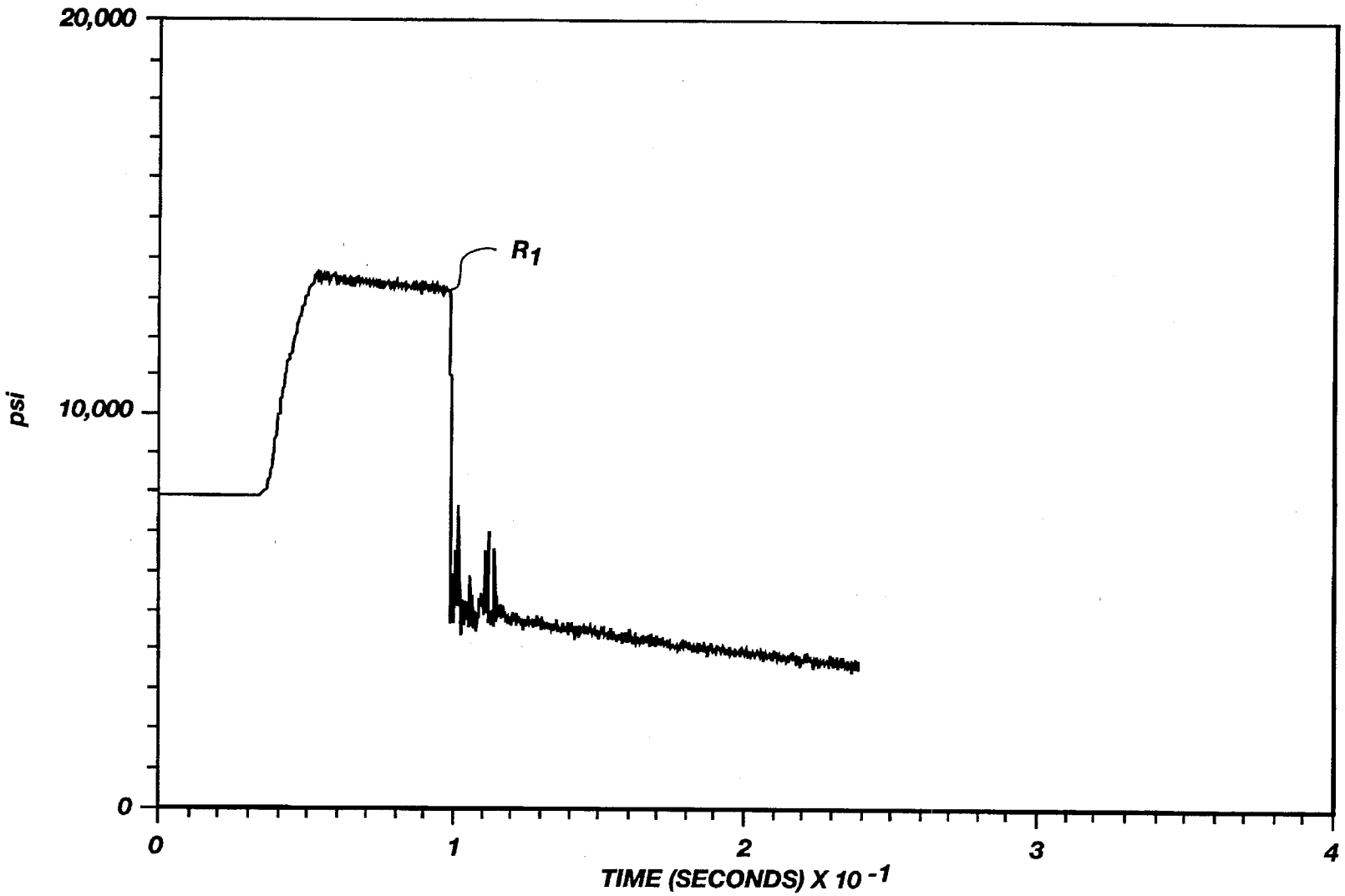
FIG. 8 illustrates a graphical depiction of a hydro burst test performed upon a first embodiment of the present invention.
Figure 9:
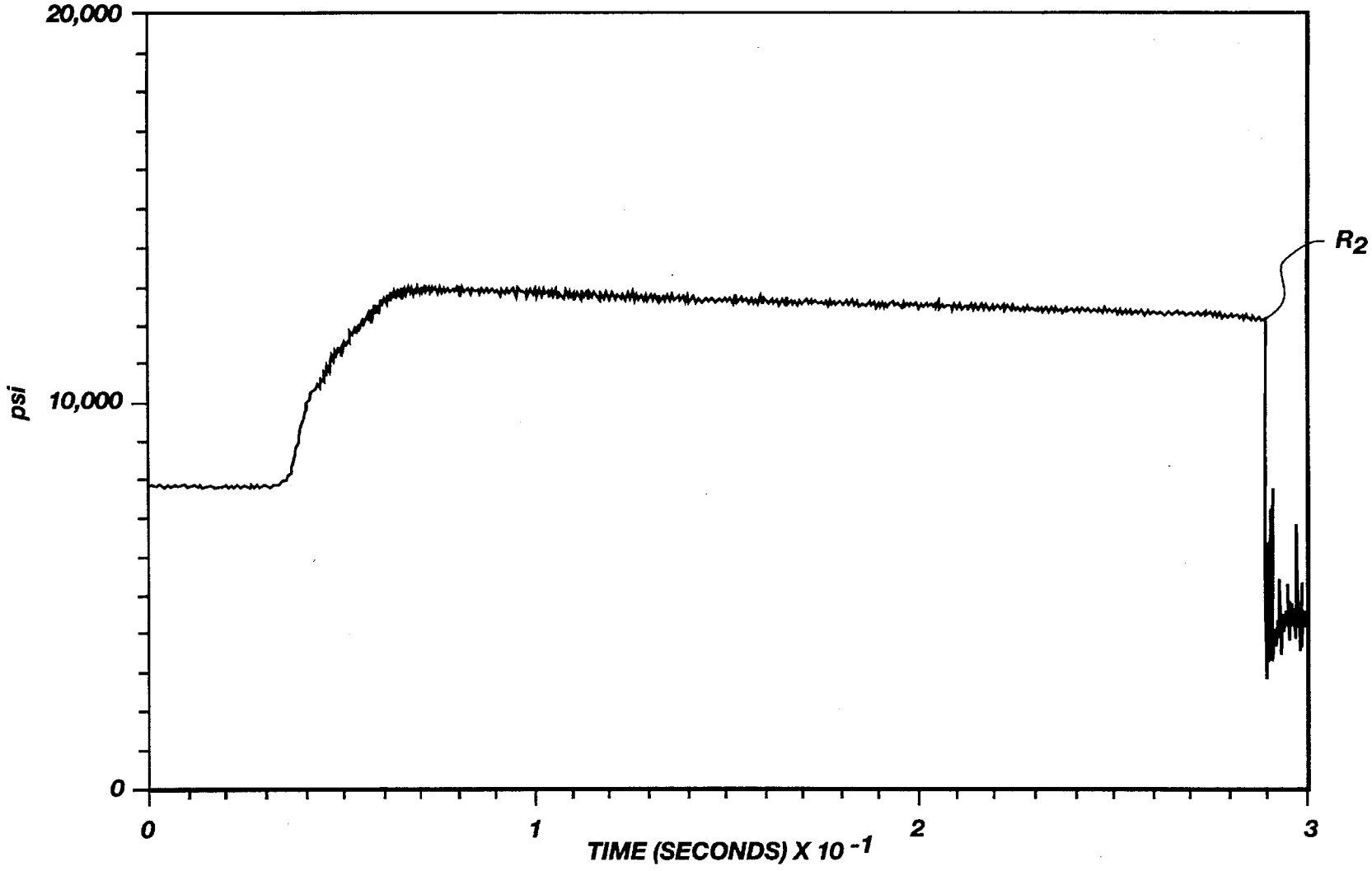
FIG. 9 illustrates a graphical depiction of a hydro burst test performed upon a second embodiment of the present invention.

FIGS. 8 and 9 respectively illustrate hydro burst test graphs for the smaller and larger sized tanks having 0.110 inches thickness, in terms of pressure versus time. Pressure transducers were used in the hydro burst tests and begin to make readings when expansion of the material first occurs. It is highly significant that the smaller tank did not even begin to expand until 7882 psi (or 71,655 $lb/in^3$ upon the 0.110 inch walls), and the larger tank did not expand until 7848 psi (or 71,345 $lb/in^3$ pressure density). This is much higher than the pressure density of 13,333 $lb/in^3$ which causes eventual failure in the prior art tanks. The failure points in FIGS. 8 and 9 are designated at $R_1$ and $R_2$, respectively. Referring now to FIG. 8, a tank 10 of the smaller dimension (length A of 9.663 inches) did not fail until subjected to approximately 13,649 psi (shown at $R_1$)

which, as exerted upon the walls 12 of 0.110 inch thickness, translates to a pressure density of 124,082 lb/in$^3$. FIG. 9 shows that a tank 10 of the larger dimension (length A of 20.0 inches) did not fail until subjected to approximately 13,168 psi (shown at $R_2$), which translates to a pressure density of 119,709 lb/in$^3$ upon the 0.110 inch thick walls. The tanks 10 can thus withstand pressure densities of up to approximately 124,000 lb/in$^3$, and at safe pressure densities in the range of 40,650 lb/in$^3$ (i.e. 5,000 psi upon 0.123 inch wall thicknesses).

The triaxial tank configuration shown in FIG. 4 can be strapped on the user's back and carried as needed, with any suitable attachment means such as the straps 48. The invention is thus useful in a number of different activities, such as scuba diving and fire fighting. A preferred method of supplying breathable air to a user includes the step of:

(a) providing at least one air tank having containing walls and being made of pressure-bearing metal;

(b) removably injecting breathable air into the tank so as to exert a pressure density upon at least a portion of the walls of the tank of approximately 40,650 lb/in$^3$; and (c) dispensing the breathable air from the tank to the user so as to enable the user to breathe the air.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A method of supplying breathable air to a user comprising the steps of:

(a) providing at least one air tank having containing walls and being made of pressure-bearing metal;

(b) removably injecting breathable air into the tank so as to exert a pressure density upon at least a portion of the walls of the tank which exceeds approximately 50,000 lb/in$^3$ without causing expansion of the tank; and (c) dispensing the breathable air from the tank to the user so as to enable the user to breathe the air.

2. A method as defined in claim 1, further comprising the step of:

(d) removably attaching the air tanks to the user to enable the user to carry the tank while breathing air dispensed therefrom.

3. A method as defined in claim 1, wherein step (a) further comprises providing a plurality of air tanks each having an air transmission passage formed therein, and wherein step (c) further comprises the steps of:

(e) providing a one-piece unitary air regulator including a plurality of air inlet channels disposed in communication with a common air outlet channel;

(f) connecting the plurality of air inlet channels of the air regulator to the plurality of air transmission passages of the air tanks, respectively, to thereby place each air tank into communication with the common air outlet;

(g) dispensing the breathable air from the common air outlet to the user such that the breathable air is withdrawn simultaneously from each of the plurality of air tanks.

4. A method as defined in claim 1 wherein step (b) further comprises injecting the breathable air into the tank to a pressure density upon the walls within a range of approximately 50,000 lb/in$^3$ to 124,000 lb/in$^3$ without causing expansion of the tank.

5. A method as defined in claim 4 wherein step (b) further comprises injecting the breathable air into the tank to a pressure density upon the walls of approximately 60,000 lb/in$^3$ without causing expansion of the tank.

6. A method as defined in claim 5, wherein step (a) further comprises providing three air tanks each having an air transmission passage formed at one end in substantial co-axial orientation therewith, and wherein step (c) further comprises the steps of:

(h) providing a one-piece unitary air regulator including three air inlet channels disposed in communication with a common air outlet channel and being collectively positioned in a triaxial configuration;

(i) connecting the three air inlet channels of the air regulator to the three air transmission passages of the air tanks, respectively, to thereby collectively position the air tanks in a triaxial configuration and to place each air tank into communication with the common air outlet;

(j) dispensing the breathable air from the common air outlet to the user such that the breathable air is withdrawn simultaneously from each of the three air tanks.

7. A method as defined in claim 6, further comprising the step of:

(k) removably attaching the air tanks to the user to enable the user to carry the tank while breathing air dispensed therefrom.

8. A method as defined in claim 7, wherein step (h) further comprises providing an air regulator with the three air inlet channels being collectively positioned in a substantially equilateral triaxial configuration, and wherein step (i) further comprises connecting the three air inlet channels to the three air inlet passages so as to position the air tanks in a substantially equilateral triaxial configuration.

9. A method as defined in claim 1 wherein step (a) further comprises forming an air tank by extruding a metal alloy comprising Carbon, Manganese, Silicon and Iron.

10. A method as defined in claim 9 wherein step (a) further comprises forming the air tank from a metal alloy comprising approximately 0.04% to 0.20% Carbon, approximately 0.5% to 2.0% Manganese, approximately 0.10% to 0.50% Silicon and approximately 97.30% to 99.36% Iron.

11. A portable air storage system for supplying breathable air to a user comprising:

three air tanks having containing walls, each tank having an air transmission passage formed at one end in substantial co-axial orientation therewith, wherein each tank is configured to releasably contain breathable air at a pressure density exerted upon the walls of the tank which exceeds approximately 20,000 lb/in$^3$; and an air regulator including three air inlet channels disposed in communication with a common air outlet channel and being collectively positioned in a triaxial configuration, wherein the three air inlet channels of the air regulator are connected to the three air transmission passages of the air tanks, respectively, to thereby position the air tanks in a triaxial configuration and to place each air tank into communication with the common air outlet;

wherein the common air outlet of the air regulator is configured for connection to air dispensing means for dispensing the breathable air from the common air outlet to the user so as to enable the user to breathe the air, such that the breathable air is withdrawn simultaneously from each of the three air tanks, the air tanks being sized and dimensioned so as to be attachable to the user to enable the user to carry the tanks while breathing air dispensed therefrom;

wherein each air tank includes a tank body having a length within a range of approximately nine inches to ten inches, an outer diameter within a range of approximately 2.375 inches to 2.380 inches, and a wall thickness within a range of approximately 0.121 inches to 0.125 inches.

12. A portable air storage system as defined in claim 11, wherein the thickness of a majority of the walls of each air tank is approximately 0.123 inches, and wherein each tank is configured to releasably contain breathable air at a pressure density exerted upon said walls within a range of approximately 20,000 lb/in$^3$ to 124,000 lb/in$^3$.

13. A portable air storage system as defined in claim 12, wherein each tank is configured to releasably contain breathable air at a pressure density exerted upon the walls of approximately 40,650 lb/in$^3$ substantially without being deformably expanded after 3000 cycles of breathable air at said pressure density of approximately 40,650 lb/in$^3$ have been dispensed from the tanks.

14. A portable air storage system as defined in claim 13, wherein each air tank further comprises:

an elongate tank body having upper and lower openings formed therein in substantial co-axial orientation with respect to the tank body;

a lower plug cap sealably disposed in the lower opening so as to sealably close off said lower opening;

an upper cap sealably disposed in the upper opening and including the air transmission passage such that breathable air is releasable from the tank only through said air transmission passage when the lower plug cap and the upper cap are sealably disposed.

15. A portable air storage system for supplying breathable air to a user comprising:

at least one air tank including an elongate tank body having an outer diameter within a range of approximately 2.375 inches to 2.380 inches and a wall thickness within a range of approximately 0.121 inches to 0.125 inches, said tank being configured to releasably contain breathable air at a pressure density exerted upon the walls of the tank of approximately 40,650 lb/in$^3$ substantially without being deformably expanded after 3000 cycles of breathable air at said pressure density of approximately 40,650 lb/in$^3$ have been dispensed from the tank;

wherein the air tank is configured for connection to air dispensing means for dispensing the breathable air to the user so as to enable the user to breathe the air, the air tank being attachable to the user to enable the user to carry the tank while breathing air dispensed therefrom.

16. A portable air storage system as defined in claim 15, wherein the air tank is made from a metal alloy comprising approximately 0.04% to 0.20% Carbon, approximately 0.5% to 2.0% Manganese, approximately 0.10% to 0.50% Silicon and approximately 97.30% to 99.36% Iron, such that the tank weighs less than approximately five pounds when filled with breathable air at the pressure density of approximately 40,650 lb/in$^3$.

17. A portable air storage system as defined in claim 16, wherein the air tank weighs approximately 4½ pounds when filled with breathable air at the pressure density of approximately 40,650 lb/in$^3$.

18. A portable air storage system as defined in claim 15, wherein the thickness of a majority of the walls of the air tank is approximately 0.123 inches.

19. A portable air storage system as defined in claim 18, wherein each air tank further comprises:

an elongate tank body having upper and lower openings formed therein in substantial co-axial orientation with respect to the tank body;

a lower plug cap sealably disposed in the lower opening so as to sealably close off said lower opening;

an upper cap sealably disposed in the upper opening and including an air transmission passage formed therein such that air is releasable from the tank only through said air transmission passage when the lower plug cap and the upper cap are sealably disposed.

20. A portable air storage system as defined in claim 15, wherein said at least one air tank comprises two air tanks each including an air transmission passage formed at one end in substantial co-axial orientation therewith, said air storage system further comprising:

an air regulator including two air inlet channels disposed in communication with a common air outlet channel and being connected to the two air transmission passages of the air tanks, respectively, to thereby place each air tank into communication with the common air outlet.

* * * * *